US006026779A

United States Patent [19]

Obata et al.

[11] Patent Number: 6,026,779

[45] Date of Patent: Feb. 22, 2000

[54] APPARATUS FOR CONTROLLING INTERNAL COMBUSTION ENGINE

[75] Inventors: Takeaki Obata; Keisuke Suzuki, both of Kanagawa; Nobutaka Takahashi, Yokohama, all of Japan

[73] Assignee: Nissan Motor Co., Ltd., Yokohama, Japan

[21] Appl. No.: 09/208,002

[22] Filed: Dec. 9, 1998

[30] Foreign Application Priority Data

Dec. 9, 1997 [JP] Japan ..... 9-338498

[51] Int. Cl.[7] ..... F02P 5/00; F02B 17/00

[52] U.S. Cl. ..... 123/295; 123/435; 123/480

[58] Field of Search ..... 123/295, 305, 123/435, 436, 480

[56] References Cited

U.S. PATENT DOCUMENTS

| | | | |
|---|---|---|---|
| 5,660,157 | 8/1997 | Minowa et al. | 123/416 |
| 5,875,757 | 3/1999 | Mizuno | 123/295 |
| 5,881,693 | 3/1999 | Mizuno | 123/295 |
| 5,947,079 | 9/1999 | Sivashankar et al. | 123/295 |

FOREIGN PATENT DOCUMENTS

| | | |
|---|---|---|
| 4-241754 | 8/1992 | Japan . |
| 5-163996 | 6/1993 | Japan . |

*Primary Examiner*—Willis R. Wolfe
*Assistant Examiner*—Hieu T. Vo
*Attorney, Agent, or Firm*—Foley & Lardner

[57] ABSTRACT

A cylinder direct-injection spark-ignition engine using at least a homogeneous combustion mode where early fuel-injection on intake stroke produces a homogeneous air-fuel mixture and a stratified combustion mode where late fuel-injection on compression stroke produces a stratified air-fuel mixture, is equipped with an electronic engine control unit connected to an electronic fuel injection system, an electronic spark-timing control system, and an electronically-controlled throttle valve. The control unit permits switching to a homogeneous combustion mode and changes the manipulated variable for engine torque correction to a spark-timing correction quantity, immediately when the demand for switching from stratified to homogeneous combustion mode occurs during a high-response torque correction. When the demand for switching from homogeneous to stratified combustion mode occurs during the high-response torque correction, switching to the stratified combustion mode is inhibited for a brief time duration until a required torque correction value reaches a predetermined criterion to continue the high-response torque correction based on the spark-timing correction quantity.

13 Claims, 11 Drawing Sheets

Pi ⟷ Δϕ0 CONVERSION TABLE

Pi ⟷ ΔAdv0 CONVERSION TABLE

Δφ0 ⟷ ΔAdv0 CONVERSION TABLE

APPARATUS FOR CONTROLLING INTERNAL COMBUSTION ENGINE

The contents of Application No. TOKUGANHEI 9-338498, filed Dec. 9, 1997, in Japan is hereby incorporated by reference.

BACKGROUND OF THE INVENTION

1. Field of the Invention

The present invention relates to an internal combustion engine equipped with an electronic control unit (ECU) or an electronic engine control module (ECM), and specifically to an electronic engine control apparatus for electronically controlling switching between an homogeneous combustion mode and a stratified combustion mode, and being capable of make a torque correction depending on engine/vehicle operating conditions.

2. Description of the Prior Art

It is a conventional practice to realize a desired torque, for example during shifting operation of an automatic transmission, utilizing feed-back control for an intake-air flow rate so that the actual engine output torque is converged to a desired torque. At the same time, a spark-timing correction is executed on the basis of the deviation between the actual engine torque and the desired torque value. Generally, the responsiveness of an electronic spark-timing control is faster than that of the electronic intake-air flow rate control. One such electronic engine control apparatus has been disclosed in Japanese Patent Provisional Publication No. 5-163996. On the other hand, recently, there have been proposed and developed various in-cylinder direct-injection spark-ignition engines in which fuel is injected directly into the engine cylinder. Generally, on such direct-ignition spark-ignition engines, a combustion mode is switchable between a homogeneous combustion mode and a stratified combustion mode, depending on engine/vehicle operating conditions, such as engine speed and load. In more detail, the direct-injection spark-ignition engine uses at least two combustion modes, namely an early injection combustion mode (i.e., a homogeneous combustion mode) where fuel-injection early in the intake stroke produces a homogeneous air-fuel mixture diffused adequately in the combustion chamber, and a late injection combustion mode (or a stratified combustion mode) where late fuel-injection delays the event until the end of the compression stroke to produce a stratified air-fuel mixture and to carry the mixture layer to the vicinity of the spark plug.

SUMMARY OF THE INVENTION

In such cylinder direct-injection spark-ignition engines, assuming that a torque correction is executed by way of spark-timing control during the stratified combustion mode, sparks must be produced at a timing when the air/fuel mixture reaches a region closer to the spark plug. However, the range over which the spark timing can be adjusted is too narrow to satisfactory torque correction during the stratified combustion. Under such a condition, an attempt to correct the spark timing to an excessive extent may result in a remarkably-degraded combustion performance or eventually cause undesired misfire. To the contrary, a torque correction can be satisfactorily executed through spark-timing control during the homogeneous combustion mode where the mixture is sufficiently diffused in the combustion chamber. Also, the quantity of exhaust emissions are scarcely affected by the spark-timing control, since an air-fuel ratio is not affected by the spark-timing correction.

Thus, the spark-timing control has the advantage of maintaining a superior exhaust emission control. Thus, during the homogeneous combustion mode, the spark-timing control is superior to the feed-back control for intake-air flow rate, from the viewpoint of a so-called high-response of engine torque control.

U.S. patent application Ser. No. 09/104,359, filed Jun. 25, 1998 and assigned to the assignee of the present invention, teaches the use of the spark-timing control during the homogeneous combustion mode, and the use of the equivalent ratio during the stratified combustion mode, for the purpose of ensuring a high response of engine torque control. In such a torque control device (or such an engine controller) disclosed in the U.S. patent application Ser. No. 09/104,359, assuming that the demand for switching from one of different combustion modes to the other occurs during the high-response torque control, it is necessary to switch between the torque correction based on changes in the equivalent ratio and the torque correction based on adjustment of the spark timing. From the viewpoint of the limited capacity of ROM (random access memory) or production costs, it is impossible to prepare a number of equivalent-ratio versus spark-timing conversion tables suitable to all of engine/vehicle operating conditions. Practically and generally, the number of required equivalent-ratio versus spark-timing conversion tables are largely reduced to the minimum permissible number. If such conversion between equivalence ratio and spark timing is achieved by way of arithmetic calculations, there is a possibility that the accuracy of engine torque control is lowered during conversion between the equivalent ratio and the spark timing. FIG. 4 shows an example of a torque correction factor versus equivalent-ratio correction factor conversion table, whereas FIG. 5 shows an example of a torque correction factor versus spark-timing correction quantity conversion table. For example, the equivalent-ratio correction factor versus spark-timing correction quantity conversion table indicated by the solid line shown in FIG. 12 can be arithmetically derived from the two conversion tables shown in FIGS. 4 and 5. Therefore, the use of such arithmetic processing may eliminate the necessity of the map data of FIG. 12, to be stored in the computer memories (ROM). However, there is an increased tendency for actual characteristics (see the broken line shown in FIG. 12) for conversion between an equivalent-ratio correction factor and a spark-timing correction quantity to be offset from the previously-noted arithmetically-calculated conversion table (see the solid line shown in FIG. 12). The discrepancy between the actual characteristic curve and the arithmetically-calculated characteristic curve, may produce the discontinuity between a torque correction factor based on the equivalent ratio correction during the stratified combustion, and a torque correction factor based on the spark-timing correction after switching to the homogeneous combustion. In other words, there is a possibility that a noticeable torque change (or a noticeable drive-train shock) occurs owing to the replacement of a manipulated variable necessary for feedback control for engine output torque from the equivalent ratio to the spark timing. To avoid this, U.S. patent application Ser. No. 09/110,413, filed Jul. 6, 1998 and assigned to the assignee of the present invention, teaches the inhibition of switching operation between the stratified combustion mode and the homogeneous combustion mode, accounting for a direction of combustion-mode switching (depending on whether the combustion mode is switched to the stratified combustion or to the homogeneous combustion), when the demand for switching between the combustion modes under a transient condition where the system is operating at the high-response torque control mode. In more detail, in the presence of demand for switching to homogeneous combustion, a timing of switching to the manipulated variable (i.e., the spark timing) used in the homogeneous combustion mode is delayed by a predetermined lag time later than a timing of switching from the stratified combustion mode to the homogeneous combustion mode, thereby avoiding the previously-noted noticeable torque change (the drivetrain shock). Conversely, in the presence of demand for switching to stratified combustion, the timing of switching to the manipulated variable (i.e., the equivalent ratio) used in the stratified combustion mode is so designed to be identical to the timing of switching from the homogeneous combustion mode to the stratified combustion mode, thereby ensuring a high-response switching with respect to the manipulated variable. In the above-mentioned combustion mode control or the electronic engine control, at all times when the demand for switching to the homogeneous combustion mode is present due to an increase in required torque, the timing of switching of the manipulated variable from the spark timing to the equivalent ratio is delayed by the predetermined time duration. This somewhat lowers the total responsiveness for torque control achieved by the ECU or ECM, thus reducing the driveability. On the other hand, when the demand for switching to the stratified combustion mode is present due to a decrease in the required torque, the homogeneous combustion mode can be continually executed, while dropping down the engine output torque depending on the target decrement of the required torque, because, in the conventional ECU, in order to make a torque correction, only one manipulated variable (for example, a spark-timing) is used in the stratified combustion mode, whereas an additional manipulated variable (for example, an equivalent ratio) as well as the previously-noted one manipulated variable (the spark timing) are both used in the homogeneous combustion mode. As discussed above, it is preferable that the combustion mode remains at the homogeneous combustion mode for a while, in the presence of demand for switching to the stratified combustion, arisen from the engine-torque decreasing demand. This prevents a noticeable toque change which may occur when the manipulated variable for high-response torque control is changed at the same timing as switching between the combustion modes.

Accordingly, it is an object of the invention to provide an internal combustion engine with an electronic control unit which avoids the aforementioned disadvantages of the prior art.

It is another object of the invention to provide an automotive engine control apparatus, which ensures an optimal engine control or good transition between at least two combustion modes with less torque change (or less drivetrain shock) by electronically controlling the timing of switching between a stratified combustion mode and a homogeneous combustion mode depending on the direction of switching of the combustion mode, when the demand for switching between the combustion modes during the high-response engine-torque control.

In order to accomplish the aforementioned and other objects of the present invention, a cylinder direct-injection spark-ignition engine using at least a homogeneous combustion mode where early fuel-injection on intake stroke produces a homogeneous air-fuel mixture and a stratified combustion mode where late fuel-injection on compression stroke produces a stratified air-fuel mixture, comprises a control unit configured to be connected to at least an electronic fuel injection system. The control unit comprises a combustion switching section connected to the electronic fuel injection system for switching between the homogeneous combustion mode and the stratified combustion mode depending on an engine operating condition, a torque-correction demand section for demanding a torque correction of the cylinder direct-injection spark-ignition engine depending on the engine operating condition, a torque-correction section for making the torque correction by manipulating one of a first unique manipulated variable used in the homogeneous combustion mode and a second unique manipulated variable used in the stratified combustion mode, the first and second unique manipulated variables being different from each other, and a combustion-switching permission decision section for deciding whether execution of a combustion mode change ought to be made, depending on a direction of switching from one of the combustion modes to another combustion mode, when a demand for switching between the combustion modes occurs during the torque correction, wherein the combustion-switching section performs a switching operation from one of the combustion modes to another combustion mode, only when the combustion mode change is permitted by the combustion-switching permission decision section.

DESCRIPTION OF THE PREFERRED EMBODIMENTS

Figure 2:
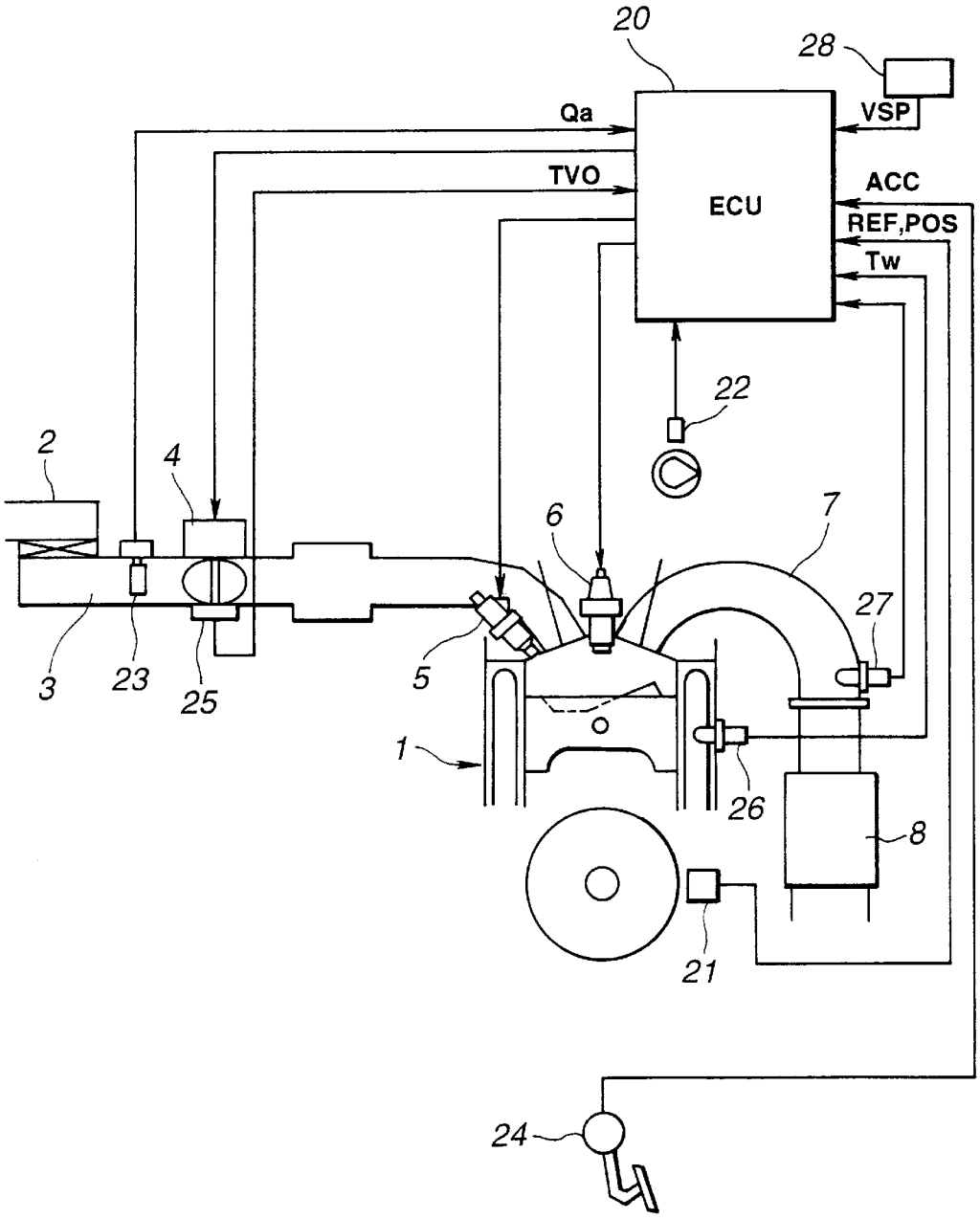
FIG. 2 is a system block diagram illustrating one embodiment of an electronic engine control apparatus of the invention.

Referring now to the drawings, particularly to FIG. 2, an electronic concentrated engine control apparatus of the invention is exemplified in a cylinder direct-injection spark-ignition DOHC engine equipped with an electronically-controlled throttle valve device. As seen in FIG. 2, all air, entering the combustion chamber of each engine cylinder of the engine 1, passes first through an air cleaner 2, flows via an intake-air passage 3 toward an electronically-controlled throttle valve 4. The electronically-controlled throttle valve 4 is disposed in the intake-air passage 3 of the induction system, to electronically control the throttle opening (i.e., the flow rate of intake air entering each intake-valve port), irrespective of depression of the accelerator pedal. The opening and closing of the electronically-controlled throttle valve 4 is controlled generally by means of a stepper motor (not numbered), also known as a "stepping motor" or a "step-servo motor". The stepper motor of the electronically-controlled throttle valve 4 is connected via a signal line to the output interface or a drive circuit of an electronic control unit 20, so that the angular steps or essentially uniform angular movements of the stepper can be obtained electromagnetically depending on a control signal or a drive signal from the output interface of the ECU. The electronic fuel-injection system of the direct-injection engine 1 comprises an electromagnetic fuel-injection valve (simply an electromagnetic fuel injector) 5 is provided at each engine cylinder, so that fuel (gasoline) can be injected directly into each combustion chamber. The amount of fuel injected from the electromagnetic fuel injector 5 into the associated engine cylinder is controlled by the pulse-width time (a controlled duty cycle or duty ratio) of a pulsewidth modulated (PWM) voltage signal (simply an injection pulse signal). In more detail, the output interface of the electronic control unit 20 generates the injection pulse signal on the intake stroke and on the compression stroke, in synchronization with revolutions of the engine. The electromagnetic solenoid of the fuel injector 5 is energized and de-energized by the duty cycle pulsewidth modulated (PWM) voltage signal (the injector pulse signal) at a controlled duty cycle. In this manner, the valve opening time of the fuel injector 5 can be controlled by way of the controlled duty cycle and also the fuel, regulated to a desired pressure level, can be injected via the fuel injector and delivered directly into the associated engine cylinder. The direct-injection engine 1 of the embodiment uses at least two combustion modes, one being an early injection combustion mode (or a homogeneous combustion mode) where fuel-injection early in the intake stroke produces a homogeneous air-fuel mixture, and the other being a late injection combustion mode (or a stratified combustion mode) where late fuel-injection delays the event until near the end of the compression stroke to produce a stratified air-fuel mixture. During the homogeneous combustion mode, the early injection in the intake stroke enables the fuel spray to be diffused within the combustion chamber and then to be mixed more uniformly with the air. During the stratified combustion mode, the incoming air mixes with the denser fuel spray due to the late injection in the compression stroke, to create a rich mixture around a spark plug 6 for easy ignition, while the rest of the air-fuel mixture after late injection is very lean at edges of the combustion chamber. The ignition system of the direct-injection engine 1 is responsive to an ignition signal from the ECU 20, for igniting the air-fuel mixture to ensure the homogeneous combustion on the intake stroke and to ensure the stratified combustion on the compression stroke. Roughly speaking, the combustion modes are classified into a homogeneous combustion mode and a stratified combustion mode. If the air/fuel ratio is taken into account, the homogeneous combustion modes are further classified into a homogeneous stoichiometric combustion mode and a homogeneous lean combustion mode. Herein, the air/fuel ratio of the homogeneous stoichiometric combustion mode is 14.6:1 air/fuel ratio (AFR). The air/fuel ratio of the homogeneous lean combustion mode is 20:1 to 30:1 AFR (preferably 15:1 to 22:1 AFR). The air/fuel ratio of the stratified combustion mode (exactly the lean stratified combustion mode or the ultra-lean stratified combustion mode) is 25:1 to 50:1 (preferably 40:1 AFR). The burnt gases are exhausted from the engine cylinder into the exhaust passage 7. As seen in FIG. 2, a catalytic converter 8 is installed in the exhaust passage 7, for converting the pollutants coming from the engine into harmless gases.

The electronic control unit 20 comprises a microcomputer, generally constructed by a central processing unit (CPU), a read only memory (ROM), a random access memory (RAM), an analog-to-digital converter, an input/output interface circuitry (or input/output interface unit), and the like. As seen in FIG. 2, the input interface of the control unit 20 receives various signals from engine/vehicle sensors, namely a crank angle sensor 21, a camshaft sensor 22, an air flow meter 23, an accelerator position sensor (or an accelerator sensor) 24, a throttle sensor 25, a coolant temperature sensor 26, an oxygen sensor ($O_2$ sensor) 27, and a vehicle speed sensor 28. The crank angle sensor 21 or the camshaft sensor 22 is provided for detecting revolutions of the engine crankshaft (or the rotation of the camshaft). Assuming that the number of engine cylinders is "n", the crank angle sensor 21 generates a reference pulse signal REF at a predetermined crank angle for every crank angle 720°/n, and simultaneously generates a unit pulse signal POS (1° signal or 2° signal) for every unit crank angle (1° or 2°). The CPU of the control unit 20 arithmetically calculates an engine speed Ne for example on the basis of the period of the reference pulse signal REF from the crank angle sensor 21. The air flow meter 23 is provided in the intake-air passage 3 upstream of the electronically-controlled throttle valve 4, to generate an intake-air flow rate signal indicative of an actual intake-air flow rate (or an actual air quantity) Qa. The accelerator position sensor 24 is located near the accelerator pedal to detect an accelerator opening ACC (i.e., a depression amount of the accelerator pedal). The throttle sensor 25 is located near the electronically-controlled throttle 4 to generate a throttle sensor signal indicative of a throttle opening TVO which is generally defined as a ratio of an actual throttle angle to a throttle angle obtained at wide open throttle. The throttle sensor 25 involves an idle switch (not numbered) which is switched ON with the throttle 4 fully closed. The coolant temperature sensor 26 is located on the engine 1 (for example on the engine block) to sense the actual operating temperature (coolant temperature Tw) of the engine 1. The vehicle speed sensor 28 generates a vehicle speed sensor signal indicative of a vehicle speed VSP. The exhaust gas oxygen sensor 27 is located in the exhaust passage 7, to monitor the percentage of oxygen contained within the exhaust gases at all times when the engine 1 is running, and to produce input information representative of how far the actual air-fuel ratio (AFR) deviates from the closed-loop stoichiometric air-fuel ratio (12.6:1). During the closed loop engine operating mode where the exhaust temperature has risen to within a predetermined temperature range, the voltage signal from the $O_2$ sensor 27 is used by the engine control unit (ECU). As is generally known, a voltage level of the voltage signal generated from the $O_2$ sensor 27 is different depending on the oxygen content (high oxygen or low oxygen) in the engine exhaust gases. In case of lean air-fuel mixture (high oxygen concentration), the $O_2$ sensor 27 generates a low voltage signal. On the contrast, in case of rich air-fuel mixture (low oxygen concentration), the $O_2$ sensor 27 generates a high voltage signal. Based on the various vehicle/engine sensor signals REF, POS, Qa, ACC, TVO, Tw, and a voltage signal from the $O_2$ sensor 27, the electronic control unit 20 executes predetermined or pre-programmed arithmetic calculations to achieve various tasks, namely a throttle opening control via the electronically-controlled throttle 4 in the induction system, a fuel-injection amount control and an injection timing control via the electromagnetic solenoid of the fuel injector 5 in the electronic fuel-injection system, and a spark timing control or an ignition timing control via the spark plug 6 in the computer-controlled electronic ignition system. The electronic concentrated engine control apparatus of the cylinder direct-injection spark-ignition engine of the embodiment performs the arithmetic calculations or data processing as described hereunder.

Figure 3:
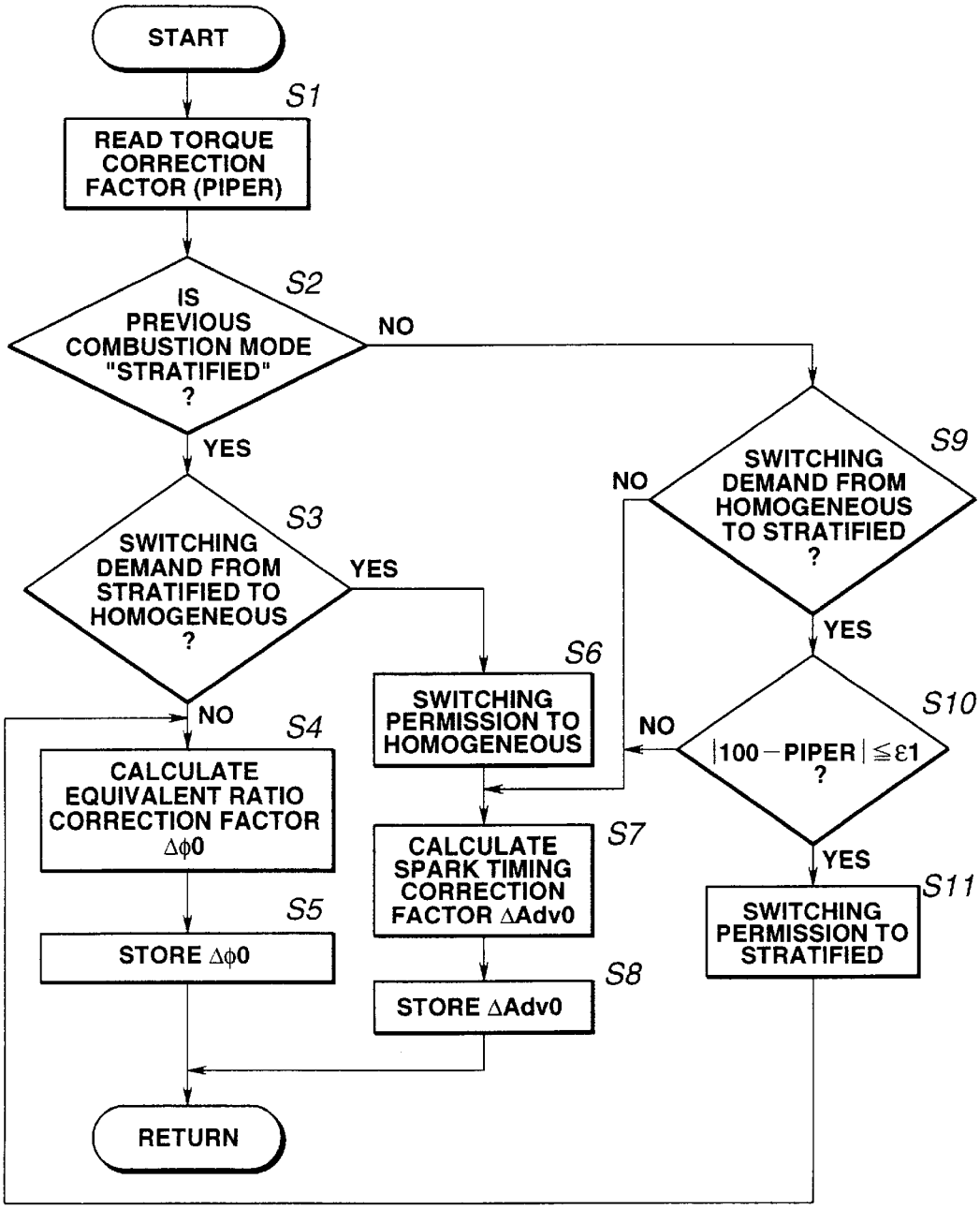
FIG. 3 is a flow chart illustrating a first torque correction plus combustion-mode switching control routine executed by the control apparatus of the embodiment shown in FIG. 2.
Figure 4:
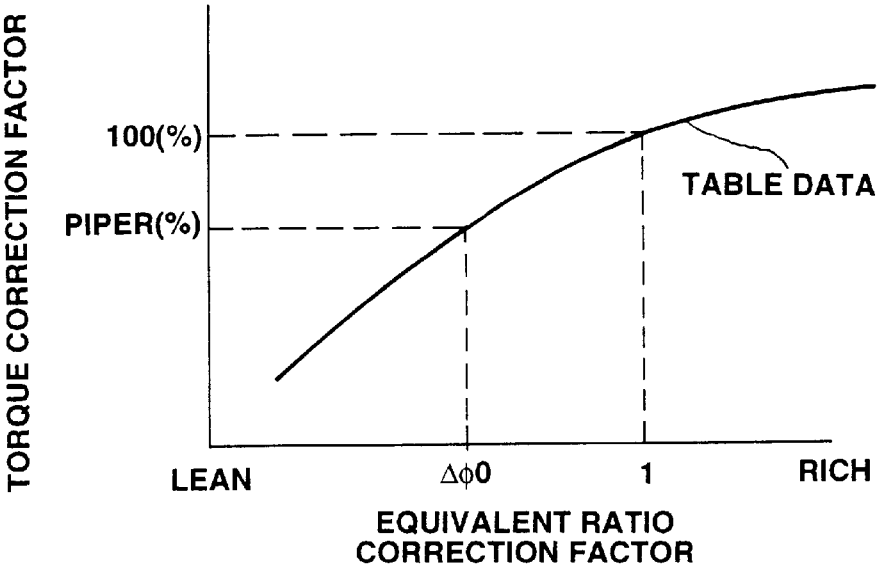
FIG. 4 is one example of a torque correction factor versus equivalent-ratio correction factor conversion table used in the above-mentioned torque correction plus combustion-mode switching control routine of FIG. 3.

Referring now to FIG. 3, there is shown the first torque correction (the high-response torque control) plus combustion-mode switching control routine. The routine (the flow chart shown in FIG. 3) is executed as time-triggered interrupt routines to be triggered every predetermined time intervals, such as 10 milliseconds, while the demand for high-response torque correction takes place.

In step S1, a torque correction factor PIPER used during the high-response torque control is read. In order to derive the torque correction factor PIPER, a target torque Te is first calculated in accordance with the arithmetic calculation shown in FIG. 10. Second, on the basis of the calculated target torque Te, the torque correction factor PIPER is arithmetically calculated through the flow chart shown in FIG. 11.

Figure 10:
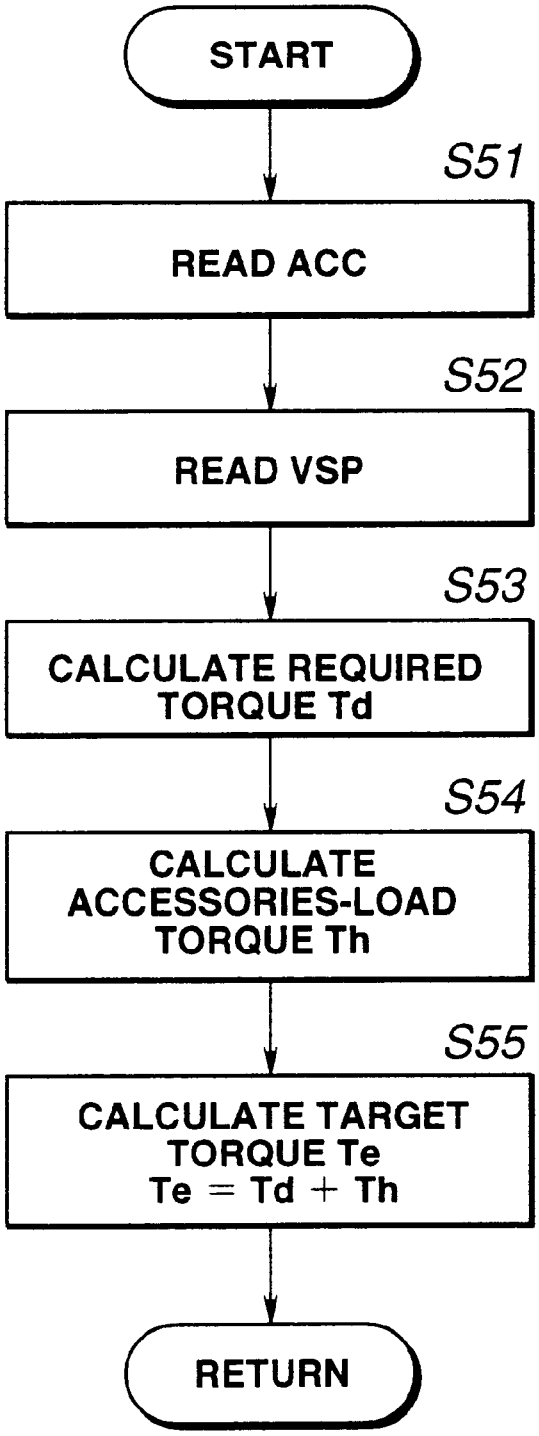
FIG. 10 is a flow chart for arithmetic calculation of a target torque Te (or a desired torque) used in each of the first, second, and third routines.

According to the arithmetic calculation shown in FIG. 10, an accelerator opening ACC is read in step S51, and then a vehicle speed VSP is read in step S52. Thereafter, in step S53, a driver's required torque or a driver-required torque Td (a torque component based on the driver's wishes) is retrieved on the basis of both the accelerator opening ACC and the vehicle speed VSP, from a predetermined or pre-programmed characteristic map representative of the relationship among the accelerator opening ACC, the vehicle speed VSP, and the driver-required torque Td. In step S54, accessories load torque Th is calculated or estimated on the basis of switched-ON or switched-OFF conditions of the accessories (for example, an air conditioner) mounted on the engine. A target torque Te (or a desired engine-power output) is arithmetically calculated by adding the engine-accessories-load torque Th to the driver-required torque Td.

Figure 11:
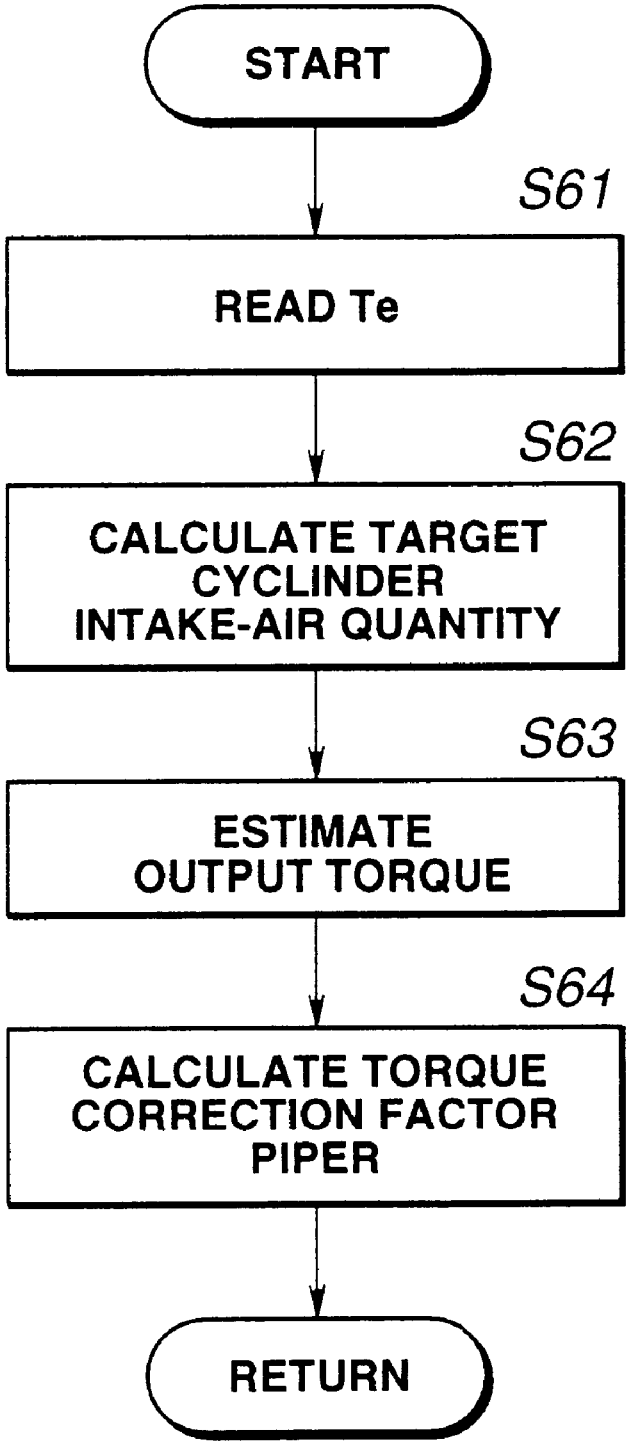
FIG. 11 is a flow chart for arithmetic calculation of a torque correction factor PIPER used in each of the first, second, and third routines.
Figure 12:
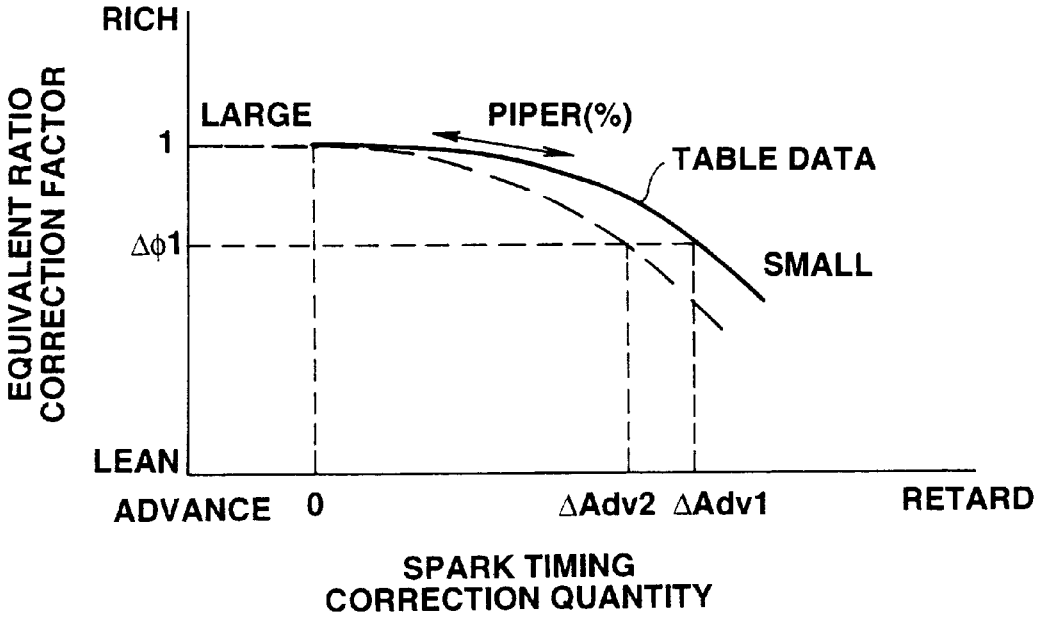
FIG. 12 shows the equivalent-ratio correction factor versus spark-timing correction quantity conversion table.

According to the arithmetic calculation shown in FIG. 11, the target torque Te, obtained through the routine shown in FIG. 10, is read in step S61. Then, in step S62, a target cylinder intake-air quantity is retrieved from a predetermined or preprogrammed characteristic map representative of the relationship among the target torque Te, the engine speed Ne, and the target cylinder intake-air quantity. In the throttle control system, a target throttle opening of the throttle 4, necessary to provide the retrieved target cylinder intake-air quantity, is calculated by way of another sub-routine (not shown), so that the actual throttle opening is adjusted to the target throttle opening through feedback control. Then, the quantity of air sucked into the engine cylinder by way of adjustment to the target throttle opening is estimated. On the basis of the estimated cylinder intake-air quantity, the output torque is estimated through step S63. In step S64, the torque correction factor PIPER is calculated or computed as the ratio (%) of the target torque Te (obtained through the routine of FIG. 10 and read in step S61) to the output torque estimated in step S63. Step 1 of the first routine shown in FIG. 3 uses the torque correction factor PIPER derived through the sub-routines shown in FIGS. 10 and 11.

Figure 5:
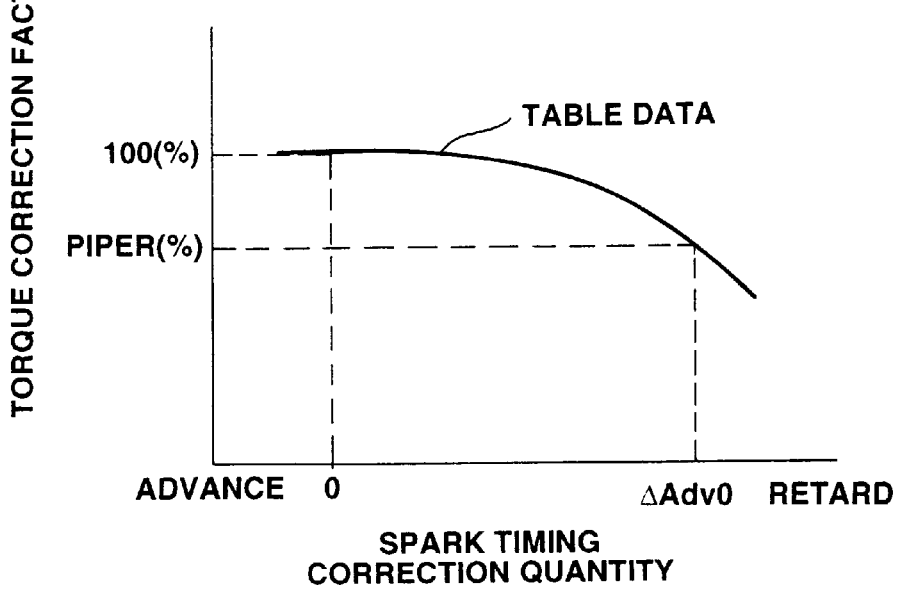
FIG. 5 is one example of a torque correction factor versus spark-timing correction quantity (represented as an advanced or retarded crank angle) conversion table used in the torque correction plus combustion-mode switching control routine of FIG. 3.

Returning to FIG. 3, in step S2, the latest up-to-date combustion mode data is derived and then a test is made to determine whether the previous combustion mode is a stratified combustion mode, on the basis of the latest up-to-date informational data. When the answer to step S2 is in the affirmative (YES), step S3 occurs. In step S3, a check is made to determine whether the demand for switching from stratified to homogeneous combustion mode is present. Hereupon, the combustion mode is determined or retrieved from a predetermined combustion-mode switching map data representative of the relationship among engine speed (Ne), engine load (usually estimated from a basic fuel-injection amount Tp), and the combustion mode, through another sub-routine (not shown). In step S3, when the answer to step S3 is in the negative (NO), that is, when the CPU of the ECU 20 determines that there is no demand for switching from stratified to homogeneous combustion mode, step S4 enters. By means of step 4, an equivalent-ratio correction factor $\Delta\phi 0$ is arithmetically calculated or retrieved from the torque correction factor (Pi) versus equivalent-ratio correction factor ($\Delta\phi 0$) conversion table. Thereafter, in step S5, the equivalent-ratio correction factor ($\Delta\phi 0$), obtained through step S4 of the current routine, is stored in a predetermined memory address (a variable data address). In other words, the previous equivalent-ratio correction factor $\Delta\phi 0_{(n-1)}$ is updated by the more recent equivalent-ratio correction factor $\Delta\phi 0_{(n)}$ through step S5. An equivalent ratio $\phi$ is compensated for by the equivalent-ratio correction factor $\Delta\phi 0$, calculated at step S4, by way of another job or task. According to a series of flow from step S1 through steps S2, S3 and S4 to step S5, a torque correction is made on the basis of the torque correction factor PIPER. To the contrary, when the answer to step S3 is affirmative (YES), that is, when the CPU of the ECU 20 determines that there is the demand for switching from stratified to homogeneous combustion mode, the routine proceeds to step S6. In step S6, the ECU 20 permits switching to the homogeneous combustion mode. The ECU 20 generates an enable signal for switching to homogeneous combustion. Then, the procedure flows to step S7. In step S7, a spark-timing correction quantity $\Delta Adv\mathbf{0}$ relating to the torque correction factor PIPER is retrieved from the map data shown in FIG. 5. Thereafter, in step S8, the retrieved spark-timing correction quantity $\Delta Adv\mathbf{0}$ is stored in a predetermined memory address (a variable data address). In other words, the previous spark-timing correction quantity $\Delta Adv\mathbf{0}_{(n-1)}$ is updated by the more recent spark-timing correction quantity $\Delta Adv\mathbf{0}_{(n)}$. A spark timing is compensated for by the spark-timing correction quantity $\Delta Adv0_{(n)}$, calculated at step S7, by way of another job or task. According to a series of flow from step S1 through steps S2, S3, S6 and S7 to step S8, a torque correction is made on the basis of the torque correction factor PIPER. Then, the procedure returns to a main routine.

On the other hand, when the answer to step S2 is negative (NO), that is, when the previous combustion mode is the homogeneous combustion mode, step S9 occurs. In step S9, a check is made to determine whether the demand for switching from homogeneous to stratified combustion mode is present. When the answer to step S9 is negative (NO), that is, when the CPU of the ECU 20 determines that there is no demand for switching to the stratified combustion mode, the procedure flows via step S7 to step S8. To the contrary, when the answer to step S9 is in the affirmative (YES), that is, when the CPU of the ECU determines that the demand for switching from homogeneous to stratified combustion mode is present, step S10 enters. In step S10, a test is made to determine whether or not the deviation |100-PIPER|% of the torque correction factor PIPER % from 100% is below a predetermined value $\epsilon 1$%. The |deviation |100-PIPER| means a required torque correction value, since the torque correction factor PIPER % is defined as the ratio (%) of the target torque Te to the engine output torque. In other words, by way of step S10, the ECU determines as to whether the required torque value becomes less than the predetermined value $\epsilon 1$. This value $\epsilon 1$ is set at a preset criterion (or a reference value) used to determine that the termination of the high-response torque control or the termination of the high-response torque correction has already been completed practically. When the answer to step S10 is in the negative (NO), that is, when the condition defined by the inequality $|100\text{-PIPER}|>\epsilon 1$ is satisfied, the program proceeds to step S7, and then flows to step S8. The inequality $|100\text{-PIPER}|>\epsilon 1$ means that undesired noticeable torque change (or undesired torque difference) may take place by switching the manipulated variable for torque correction from the spark-timing correction quantity to the equivalent-ratio correction factor at the same time as the combustion mode change. In such a case, the torque correction based on the spark-timing correction quantity has been continued without any switching operation for both the combustion mode and the manipulated variable for torque correction, in accordance with the flow from step S10 via step S7 to step S8. As a result of the torque correction action as previously-noted, when the deviation |100-PIPER| becomes equal to or less than the predetermined value $\epsilon 1$, i.e., in case of $|100\text{-PIPER}|\leqq\epsilon 1$, the ECU decides that the termination of the high-response torque correction based on the spark-timing correction has been completed practically, and also decides that there is less torque difference caused by switching the torque-correction manipulated value from the spark-timing correction quantity to the equivalent-ratio correction factor at the same time as the combustion mode change. Thus, the program proceeds to step S11. In step S11, the ECU permits the combustion mode to switch from the homogeneous combustion mode to the stratified combustion mode. Thereafter, the procedure flows from step S11 to step S4, and then to step S5. Through the flow from step S11 via step S4 to step S5, the manipulated variable for torque correction is changed from the spark-timing correction quantity ($\Delta Adv0$) to the equivalent-ratio correction factor ($\Delta\phi 0$). As a result of this, the equivalent ratio ($\phi$) is corrected by the correction factor $\Delta\phi 0$, and thus the torque correction action based on the corrected equivalent ratio is made.

As discussed above, according to the first torque correction plus combustion-mode switching control routine shown in FIG. 3, the engine control apparatus of the embodiment permits switching from stratified to homogeneous combustion mode quickly without any time delay, as soon as the demand for switching from stratified to homogeneous combustion mode takes place during the high-response torque control (or the high-response torque correction). Simultaneously, the engine control apparatus changes the torque-correction manipulated variable from the equivalent ratio correction factor ($\Delta\phi 0$) to the spark-timing correction quantity ($\Delta Adv0$ being capable of producing a higher response than the equivalent ratio correction factor $\Delta\phi 0$). Thus, the engine control apparatus continually executes the high-response torque control, while satisfying the demand for increase in the driver-required torque Td with a high response. To the contrary, when the demand for switching from homogeneous to stratified combustion mode during the high-response torque control, the engine control apparatus of the embodiment performs both switching from homogeneous to stratified combustion mode and switching of the torque-correction manipulated variable from the spark-timing correction quantity $\Delta Adv0$ to the equivalent ratio correction factor $\Delta\phi 0$, just after the termination of the high-response torque correction operation has been completed practically. In other words, the engine control apparatus of the embodiment never performs two switching operations, namely a first switching operation from homogeneous to stratified combustion mode and a second switching operation from spark timing to equivalent ratio correction, until the control apparatus decides that the termination of the high-response torque correction (or the high-response torque control) has been completed on the basis of comparison result ($|100\text{-PIPER}|\leqq\epsilon 1$) between a predetermined criterion (a predetermined reference value= $\epsilon 1$) and the deviation |100-PIPER| (representative of the required torque correction value). Accordingly, the engine control apparatus of the embodiment satisfies the demand for decrease in the driver-required torque, while remaining the combustion mode unchanged (at the homogeneous combustion mode). During this period of time, there is no problem of degradation of fuel consumption, since the homogeneous combustion mode is retained for a brief moment until completion of the termination of one cycle of the high-response torque control. In this manner, the engine control apparatus of the embodiment can efficiently continue the high-response torque control and additionally avoid occurrence of torque difference arisen from an improper switching action of the torque-correction manipulated variable.

Figure 6:
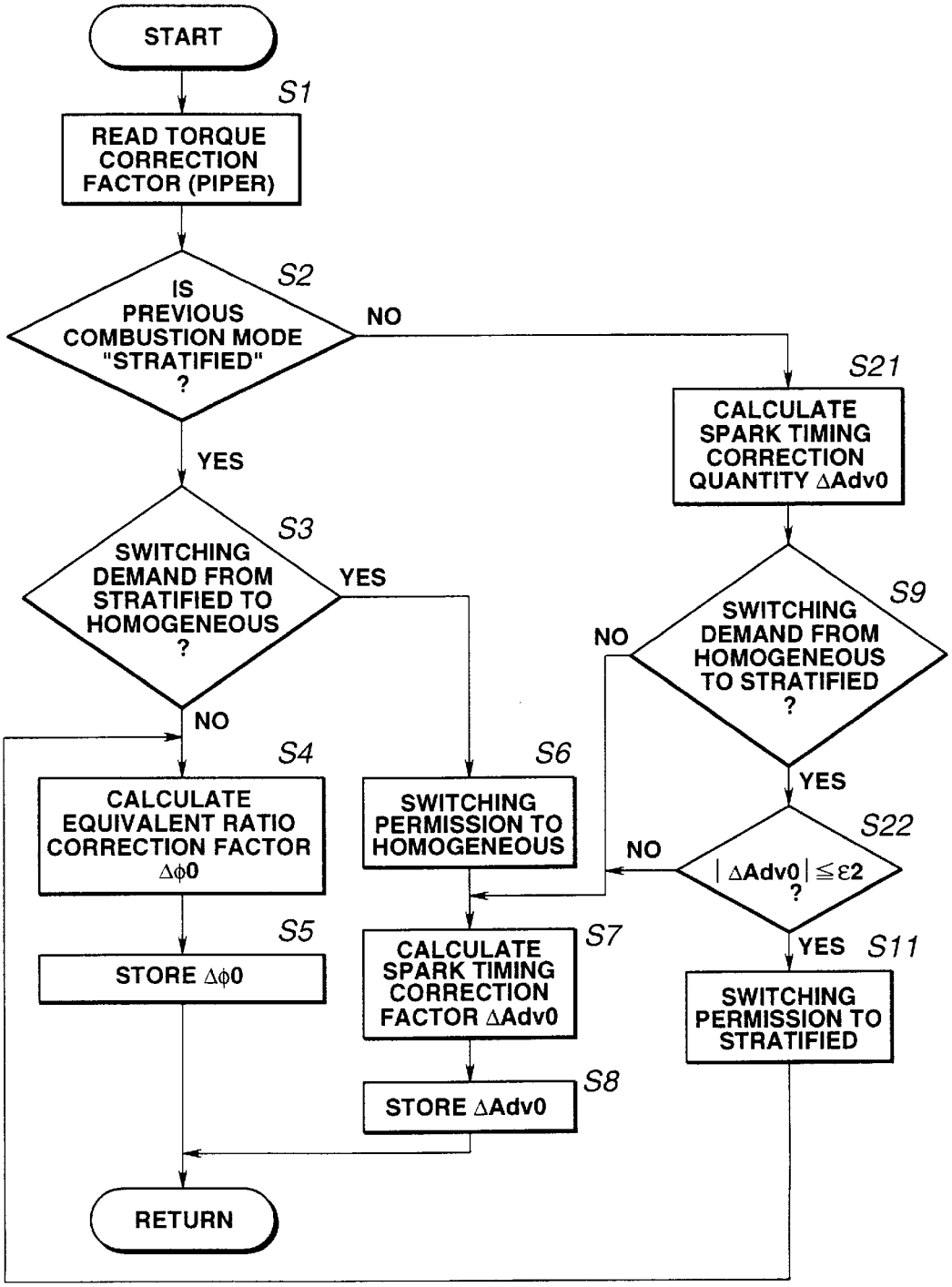
FIG. 6 is a flow chart illustrating a second torque correction plus combustion-mode switching control routine executed by the control apparatus of the embodiment shown in FIG. 2.

Referring now to FIG. 6, there is shown a second torque correction plus combustion-mode switching control routine executed by the central processing unit of the microcomputer (ECU) employed in the engine control apparatus of the invention. The second arithmetic processing shown in FIG. 6 is also executed as time-triggered interrupt routines to be triggered every predetermined time intervals such as 10 milliseconds. The second arithmetic processing of FIG. 6 is similar to the arithmetic processing of FIG. 3, except that step S10 included in the routine shown in FIG. 3 is replaced with steps S21 and S22 included in the routine shown in FIG. 6. Thus, the same step numbers used to designate steps in the routine shown in FIG. 3 will be applied to the corresponding step numbers used in the modified arithmetic processing shown in FIG. 6, for the purpose of comparison between the two different interrupt routines. Steps S21 and S22 will be hereinafter described in detail with reference to the accompanying drawings, while detailed description of steps S1 through S9, and S11 will be omitted because the above description thereon seems to be self-explanatory. In the first torque correction plus combustion-mode switching control routine explained above, the switching operation to stratified combustion mode is inhibited for a brief moment depending on whether a required correction value (i.e., the deviation |100-PIPER|) is below a predetermined criterion $\epsilon 1$ (see step S10 of FIG. 3). That is to say, the brief moment corresponds to a predetermined time period during which the switching action to the stratified combustion mode is inhibited. Thus, this predetermined time period will be hereinafter referred to as a "switching-to-stratified inhibition time period". On the other hand, in the second routine shown in FIG. 6, the above-mentioned switching-to-stratified inhibition time period is set at a period of time during which the torque-correction manipulated variable becomes below a predetermined value $\epsilon 2$ during the homogeneous combustion mode, as described hereunder.

According to the second routine of FIG. 6, when the answer to step S2 is negative (NO), that is, when the ECU 20 decides that the previous combustion mode is the homogeneous combustion mode, the program flows from step S2 to step S21. In step S21, the spark-timing correction quantity ΔAdv0 corresponding to the torque correction factor PIPER is arithmetically computed or retrieved from the map data shown in FIG. 5. Then, the program proceeds to step S9. In step S9, when the ECU determines that the demand for switching from homogeneous to stratified combustion mode is occurring, the program then flows to step S22. In step S22, a test is made to determine whether the absolute value |ΔAdv0| of the spark-timing correction quantity ΔAdv0 is below a predetermined value $\epsilon 2$. When the answer to step S22 is negative, that is, when |ΔAdv0|>$\epsilon 2$, the ECU decides that undesired noticeable torque change or undesired torque difference may occur by switching the torque-correction manipulated variable from the spark-timing correction quantity ΔAdv0 to the equivalent-ratio correction factor Δϕ0 at the same time as the combustion mode change. In this case, the torque correction based on the spark-timing correction quantity has been continued without any switching operation for both the combustion mode and the torque-correction manipulated variable, in accordance with the flow from step S22 to step S8. Conversely, when the absolute value |ΔAdv0| of the spark-timing correction quantity becomes below the predetermined value $\epsilon 2$, the ECU 20 decides that there is less torque difference caused by switching the torque-correction manipulated variable from the spark-timing correction quantity to the equivalent-ratio correction factor at the same time as the combustion mode change. The program thus proceeds to step S11 in which the ECU permits the combustion mode to switch from the homogeneous combustion mode to the stratified combustion mode. And then, the procedure flows from step S11 to step S4, and then flows to step S5. By way of a series of flow from step S11 via step S4 to step S5, the switching operation of the combustion mode to the stratified combustion mode is started and completed, and also the torque-correction manipulated variable is shifted from the spark-timing correction quantity (ΔAdv0) to the equivalent-ratio correction factor (Δϕ0). As can be appreciated from the above, the second routine of FIG. 6 can bring the same effects as the first routine of FIG. 3.

Figure 7:
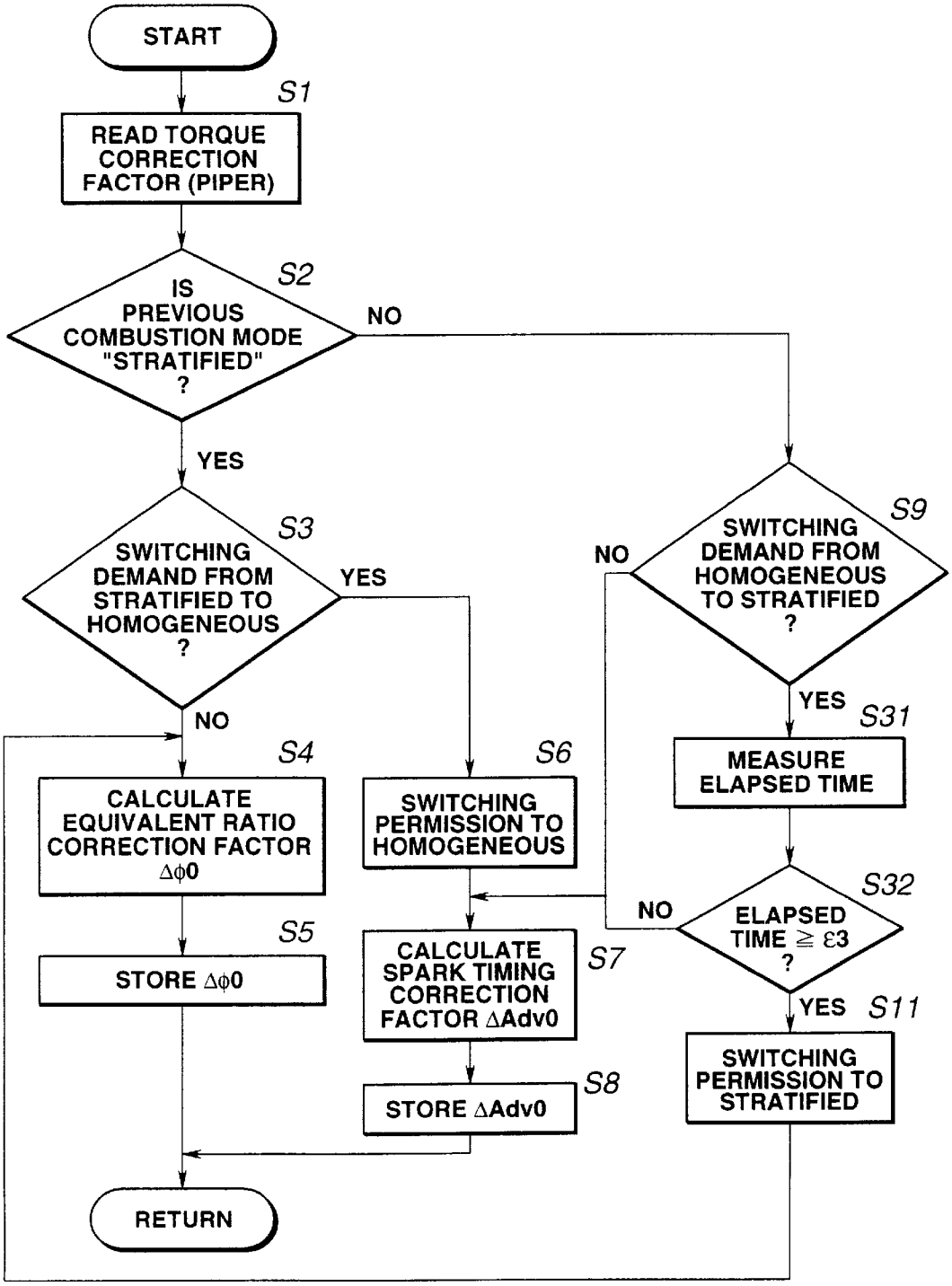
FIG. 7 is a flow chart illustrating a third torque correction plus combustion-mode switching control routine executed by the control apparatus of the embodiment shown in FIG. 2.

Referring now to FIG. 7, there is shown a third torque correction plus combustion-mode switching control routine executed by the central processing unit of the ECU employed in the engine control apparatus of the invention. The third arithmetic processing is similar to that shown in FIG. 3, except that step S10 contained In the routine shown in FIG. 3 is replaced by steps S31 and S32 contained in the routine shown in FIG. 7, and thus the same step numbers used to designate steps in the routine shown in FIG. 3 will be applied to the corresponding step numbers used in the modified arithmetic processing shown in FIG. 7, for the purpose of comparison between the two different interrupt routines. Steps S31 and S32 will be hereinafter described in detail with reference to the accompanying drawings, while detailed description of steps S1 through S9, and S11 will be omitted because the above description thereon seems to be self-explanatory. As may be appreciated from the flow chart shown in FIG. 7, in the torque correction plus combustion-mode switching control routine, the previously-noted switching-to-stratified inhibition time period is based on an elapsed time (a time duration) measured from occurrence of the demand for switching from homogeneous to stratified combustion mode. Also, the actual switching operation to stratified combustion mode is permitted and executed when the elapsed time reaches a preset time duration $\epsilon 3$, as discussed in detail.

According to the third routine of FIG. 7, when the answer to step S9 is affirmative, that is, when the ECU determines that the demand for switching from homogeneous to stratified combustion mode is present, step S31 occurs. In step S31, an elapsed time is measured from a point of time of occurrence of the demand for switching from homogeneous to stratified combustion mode by means of a timer included in the ECU. Then, the program proceeds to step S32. In step S32, a check is made to determine whether the elapsed time reaches the predetermined time duration $\epsilon 3$. When the answer to step S32 is negative (NO), that is, when the elapsed time<$\epsilon 3$, the ECU decides that the high-response torque correction is not yet attained sufficiently, and also decides that undesired torque difference may occur by switching the torque-correction manipulated variable from the spark-timing correction quantity ΔAdv0 to the equivalent-ratio correction factor Δϕ0 at the same time as the combustion mode change. Therefore, the switching operation for both the combustion mode and the torque-correction manipulated variable is inhibited, and additionally the torque correction based on the spark-timing correction quantity (ΔAdv0) has been continued in accordance with the flow from step S32 via step S7 to step S8. To the contrary, when the answer to step S32 is affirmative (the elapsed time≧$\epsilon 3$), the ECU decides that the high-response torque correction has already been attained adequately, and also decides that there is less torque difference created by switching the torque-correction manipulated variable from the spark-timing correction quantity to the equivalent-ratio correction factor at the same time as the combustion mode change. At this time, the program flows through steps S11 and S4 to step S5, so as to achieve both the switching operation of the combustion mode to the stratified combustion mode and the switching operation of the torque-correction manipulated variable to the equivalent-ratio correction factor (Δϕ0). The previously-noted preset time duration $\epsilon 3$ is set at a predetermined fixed time duration such as 1 second or 2 seconds, irrespective of whether the demand for torque correction is based on a switched-ON operation of an air conditioner switch (A/C SW), a shifting action of an automatic transmission (A/T), a fuel-cut recovery action of a fuel shutoff system, or the like. Alternatively, the preset time duration $\epsilon 3$ may be set at a unique time duration depending on a sort of demands for torque correction. In case of the latter, the preset time duration $\epsilon 3$ can be set depending on the length of the execution time for torque correction, and thus the previously-explained switching-to-stratified inhibition time period (a delay time of the combustion mode change to stratified) can be reduced to the minimum, in comparison with the former case where the time duration $\epsilon 3$ is fixed to a predetermined time duration regardless of a sort of demands for torque correction, such as A/C switched-on operation, shifting action of A/T, or the start of fuel-cut recovery action.

Figures 8A, 8B, 8C, 8D, 8E, 8F, 8G, 8H:
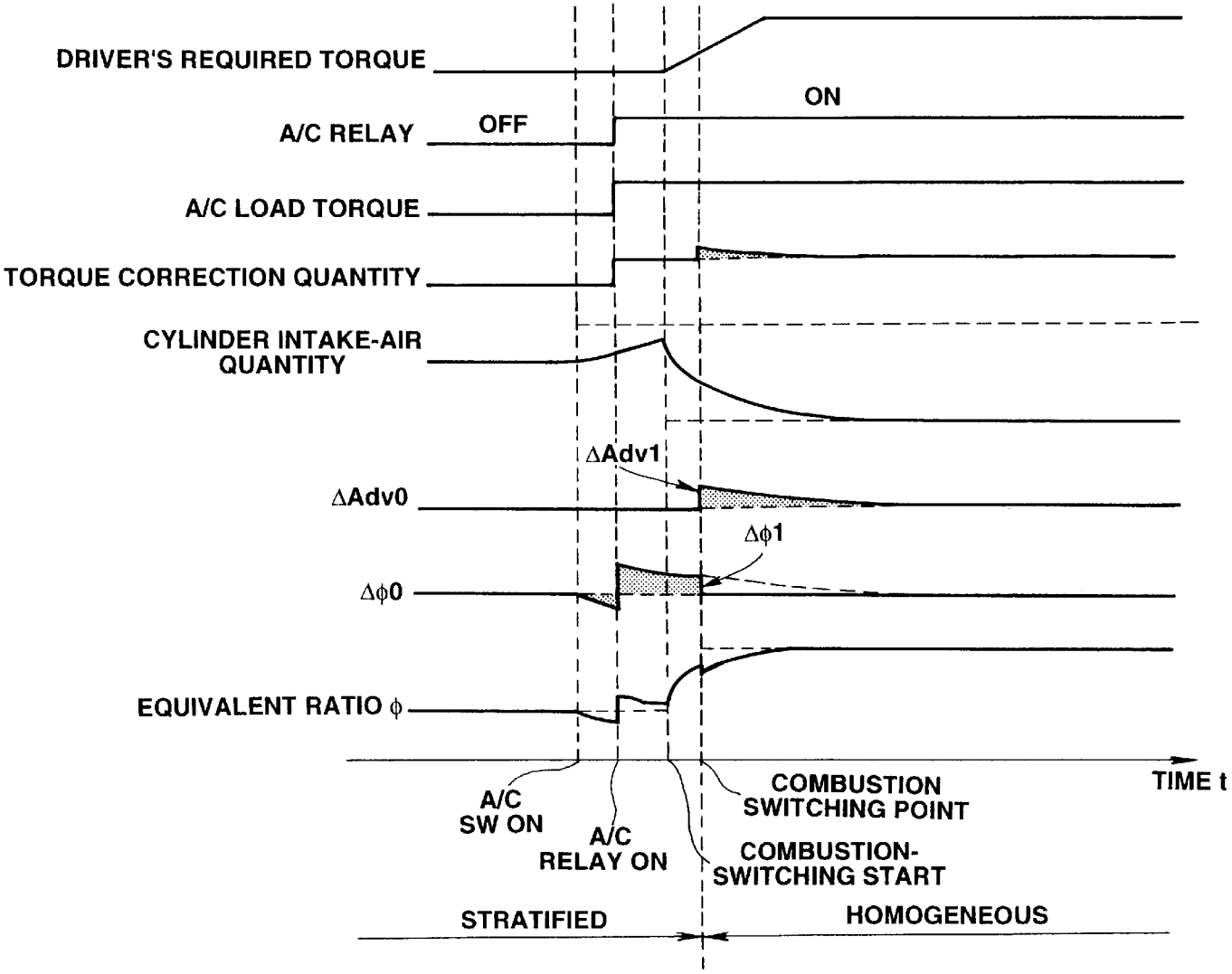
FIGS. 8A through 8H are timing charts illustrating various variables (a driver's required torque, an air conditioner (A/C) relay drive signal, an A/C load torque, torque correction quantity, a cylinder intake-air quantity, a spark-timing correction quantity $\Delta Adv0$, an equivalent-ratio correction factor $\Delta\phi 0$, and an equivalent ratio $\phi$) in the torque-correction control executable according to each of the first, second, and third routines respectively shown in FIGS. 3, 6 and 7, when switching from stratified to homogeneous combustion mode.
Figures 9A, 9B, 9C, 9D, 9E, 9F, 9G, 9H:
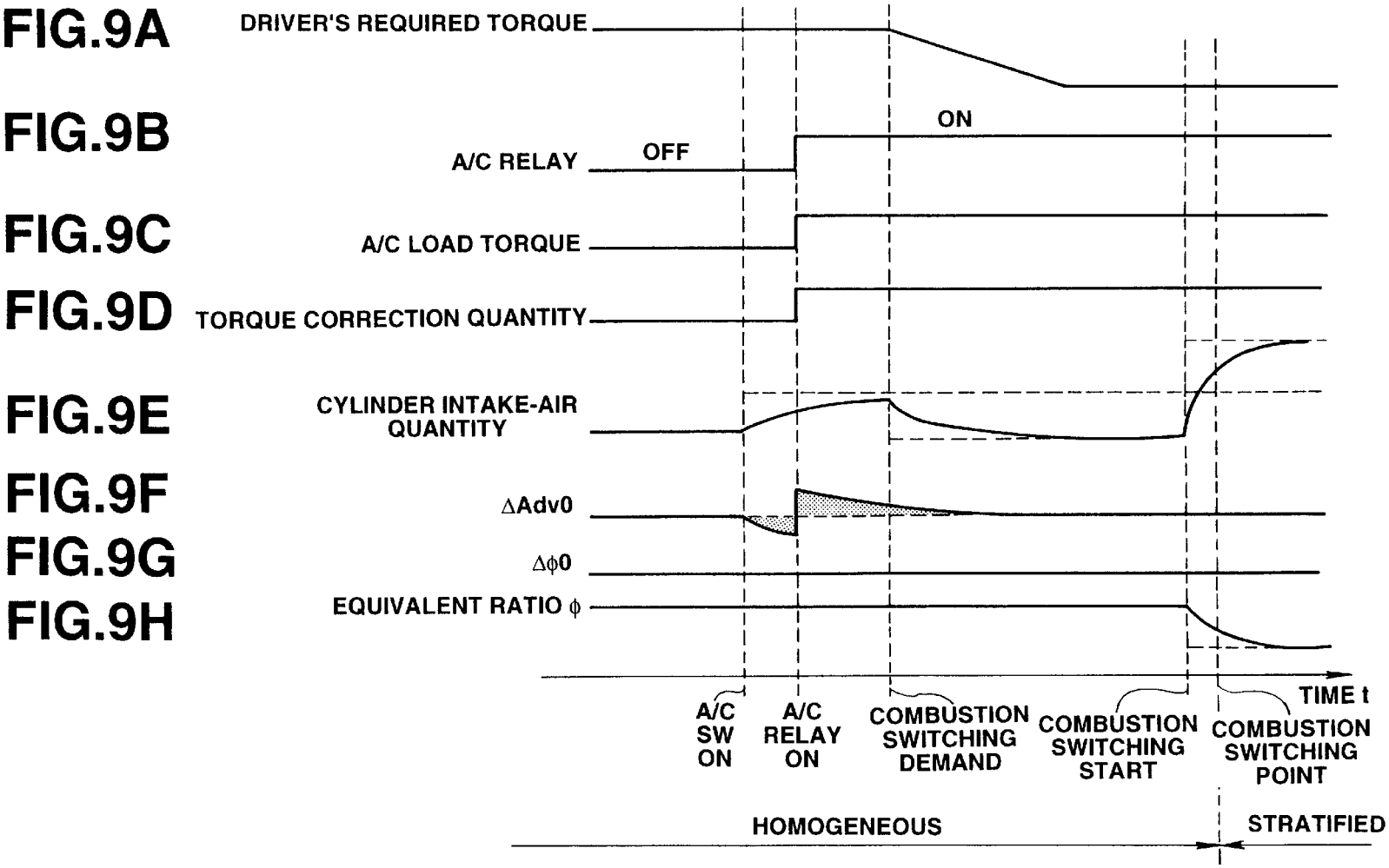
FIGS. 9A through 9H are timing charts illustrating various variables in the torque-correction control executed when switching from homogeneous to stratified combustion mode.

Timing charts shown in FIGS. 8A–8H show, in each of the previously-described first, second, and third control routines, variations in various signals and variables, namely a driver-required torque, a signal representative of the energization or de-energization of the air-conditioner relay, an air-conditioner load torque, a torque correction quantity, a cylinder intake-air quantity, a spark-timing correction quantity ΔAdv0, an equivalent -ratio correction factor Δϕ0, and an equivalent ratio ϕ, when the demand for torque correction occurs during the stratified combustion mode and then the demand for switching from stratified to homogeneous combustion mode occurs during execution of the torque correction (or the torque control). In case that the air conditioner switch is turned ON during the stratified combustion mode, a target intake-air quantity is increased due to the torque-increase demand to begin a torque-increase control, but the increase in intake-air quantity tends to be delayed. With a delay in increasing action of intake-air quantity, the equivalent-ratio correction factor Δϕ0 is gradually reduced so that the torque value is kept constant. Then, the air conditioner relay is switched ON to begin to drive the air conditioning system. At this stage, the intake-air quantity does not yet reach the target value, and thus the torque value increases with a good response by increasing the equivalent-ratio correction factor Δϕ0 in a stepwise manner. Subsequently to this, the equivalent-ratio correction factor Δϕ0 is gradually reduced in accordance with the increase in intake-air quantity for keeping the torque value at a constant value. When the demand for switching from stratified to homogeneous combustion mode occurs during execution of the torque correction based on the equivalent-ratio correction factor Δϕ0 used at the stratified combustion mode (see the flow from step S2 to step S3), the switching operation of the combustion mode to the homogeneous combustion mode is permitted at once (see step S6). At this time, the throttle opening TVO is decreased on the basis of the target cylinder intake-air quantity determined in a manner as to be suitable to the homogeneous combustion mode. However, the actual intake-air quantity gradually reduces, and thus the equivalent ratio ϕ is gradually increased in order for the torque value to kept constant. Thereafter, when the equivalent ratio ϕ, gradually increasing, reaches a certain equivalent ratio corresponding to a switching point of the combustion mode in a transient state of switching from stratified to homogeneous combustion mode, the actual combustion mode is changed to the homogeneous combustion mode. As seen in FIG. 8H and FIGS. 8F and 8G, at the same timing as switching to the homogeneous combustion mode, the manipulated variable is changed from the equivalent-ratio correction factor Δϕ0 suitable for the stratified combustion mode to the spark-timing correction quantity ΔAdv0 suitable for the homogeneous combustion mode. Actually, the equivalent-ratio correction factor Δϕ0 is fixed to zero, and simultaneously the torque-correction manipulated variable is rapidly risen on the basis of the spark-timing correction quantity calculated on the basis of the torque correction factor PIPER derived in step S1. Thereafter, the spark-timing correction quantity ΔAdv0 suitable for the homogeneous combustion mode gradually reduces until the torque correction factor PIPER approaches to 100% and reaches 100%.

Referring now to FIGS. 9A–9H, there are shown timing charts illustrating, in each of the aforementioned first, second, and third control routines, variations in various signals and variables, namely the driver-required torque, the signal representative of the energization or de-energization of the A/C relay, the A/C load torque, the torque correction quantity, the cylinder intake-air quantity, the spark-timing correction quantity ΔAdv0, the equivalent-ratio correction factor Δϕ0, and the equivalent ratio ϕ, when the demand for torque correction occurs during the homogeneous combustion mode and then the demand for switching from homogeneous to stratified combustion mode occurs during execution of the torque correction (or the torque control). In case that the A/C switch is turned ON during the homogeneous combustion mode, a target intake-air quantity begins to increase due to the torque-increase demand, but the increase in intake-air quantity tends to be delayed. With a delay in increasing action of intake-air quantity, the spark-timing correction quantity ΔAdv0 is adjusted to a retardation direction such that the torque value is kept constant. Thereafter, the A/C relay is turned ON to begin to drive the air conditioning system. In order to avoid the problem of insufficient torque owing to the shortage (deviation) of the cylinder intake-air quantity from the target cylinder intake-air quantity, the spark-timing correction quantity ΔAdv0 is advanced in a stepwise manner so as to rise the torque value with a good response. Subsequently to this, the spark-timing correction quantity ΔAdv0 is gradually reduced in accordance with the increase in intake-air quantity, thus maintaining the torque value at a constant value. When the demand for switching from homogeneous to stratified combustion mode occurs during execution of the torque correction based on the spark-timing correction quantity ΔAdv0 used at the homogeneous combustion mode (see the flow from step S2 to step S9 in FIGS. 3 and 7 or see the flow from step S2 via step S21 to step S9), the switching operation of the combustion mode to the stratified combustion mode is not permitted at once. For a brief moment (or a switching-to-stratified inhibition time period), the homogeneous combustion mode continues and additionally the torque correction based on the spark-timing correction quantity ΔAdv0 continues (see the flow from step S9 via steps S10 to step S7 in FIG. 3, the flow from step S9 via step S22 to step S8 in FIG. 6, and the flow from step S9 via steps S31 and S32 to step S7). The switching operation from homogeneous to stratified combustion mode is permitted when the spark-timing correction quantity ΔAdv0 is reduced to or converged to "0" or a sufficiently small value indicative of virtual completion of the termination of the high-response torque correction, and then the switching from homogeneous to stratified combustion mode begins. At this time, the throttle opening TVO is increased on the basis of the target cylinder intake-air quantity determined in a manner as to be suitable to the stratified combustion mode. However, a change in the actual intake-air quantity gradually tends to delay, and thus the equivalent ratio ϕ must be gradually decreased in order for the torque value to kept constant. Thereafter, when the equivalent ratio ϕ, gradually decreasing, reaches a certain equivalent ratio corresponding to a switching point of the combustion mode in a transient state of switching from homogeneous to stratified combustion mode, the actual combustion mode is changed to the stratified combustion mode.

In the shown embodiments, that is, in the previously-described first, second, and third torque correction plus combustion-mode switching control routines, the torque-correction manipulated variable is changed from the equivalent-ratio correction factor ($\Delta\phi 0$) to the spark-timing correction quantity ($\Delta$Adv0) at the same timing as the combustion mode change from stratified to homogeneous combustion mode, when the demand for switching from stratified to homogeneous combustion mode during the high-response torque control. Alternatively, in the presence of the demand for switching from stratified to homogeneous combustion mode during the high-response torque correction, only the combustion mode change may be made, while remaining the torque-correction manipulated variable at the equivalent-ratio correction factor ($\Delta\phi 0$). In such a case, the performance of exhaust emission control is somewhat affected by continuing the torque correction based on the equivalent-ratio correction factor ($\Delta\phi 0$). The torque correction based on the equivalent-ratio correction factor ($\Delta\phi 0$) is transient, and is made for a finite time duration and then terminates, and thus the emission-control performance is scarcely degraded. In the modification of the engine control apparatus just discussed above, generation of the torque difference can be effectively suppressed, since the manipulated variable for torque correction cannot be executed at the same timing as the combustion mode change to homogeneous combustion mode.

Figure 1:
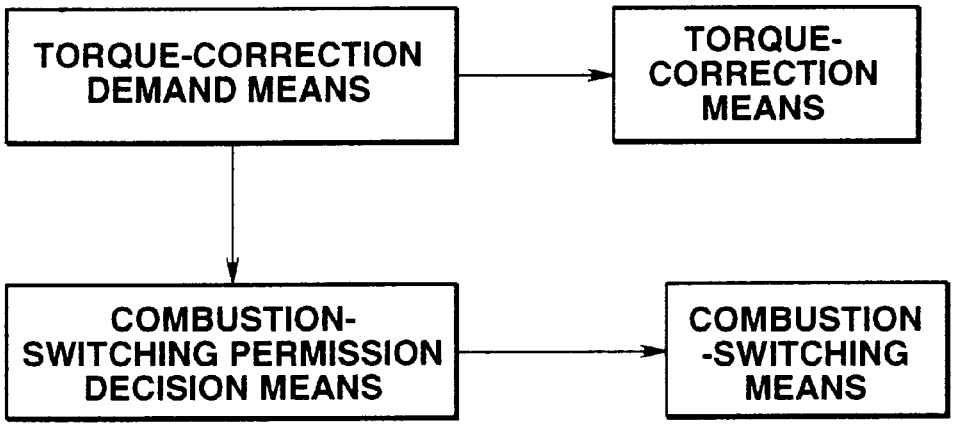
FIG. 1 is a block diagram illustrating the fundamental concept or the fundamental construction of the invention.

Referring to FIG. 1, there is shown the fundamental concept of the invention. As seen in FIG. 1, the electronic engine control apparatus, configured to be connected to at least an electronic fuel injection system, an electronic spark-timing control system, and an electronically-controlled throttle valve system, comprises a combustion switching section (or a combustion switching means) connected to the electronic fuel injection system for switching between the homogeneous combustion mode and the stratified combustion mode depending on an engine operating condition, a torque-correction demand section (or a torque-correction demand means) for demanding a torque correction of the cylinder direct-injection spark-ignition engine depending on the engine operating condition, a torque-correction section (or a torque-correction means) for making the torque correction by manipulating one of a first unique manipulated variable used in the homogeneous combustion mode and a second unique manipulated variable used in the stratified combustion mode, the first and second unique manipulated variables being different from each other, and a combustion-switching permission decision section (or a combustion-switching permission decision means) for deciding whether the execution of a combustion mode change ought to be made, depending on a direction of switching from one of the combustion modes to another combustion mode, when a demand for switching between the combustion modes occurs during the torque correction. The combustion-switching section performs a switching operation from one of the combustion modes to another combustion mode, only when the combustion mode change is permitted by the combustion-switching permission decision section.

As will be appreciated from the above, it is preferable to switch between the combustion modes at once when the demand for switching from stratified to homogeneous combustion mode takes place during the high-response torque correction (or the high-response torque control), because the rapid combustion mode change ensures a rapid generation of a required torque (or a desired torque), thus enhancing the driveability of the vehicle. That is, the quick production in the required engine torque has priority over avoidance of the undesired torque difference. Conversely, when the demand for switching from homogeneous to stratified combustion mode occurs during the high-response torque control, the demand for dropping the engine torque can be attained, while maintaining the combustion mode at the homogeneous combustion mode. In this case, the switching operation of the manipulated variable as well as the switching operation to the stratified combustion mode are inhibited, thus effectively avoiding the generation of torque difference. As discussed above, the engine control apparatus of the invention can reconcile both attainment of the driver-required torque and the high-response torque control. A regular torque control or a regular torque correction is made usually by regulating an intake-air quantity and a fuel-injection amount to satisfy a desired equivalent ratio. On the other hand, the high-response torque correction is made for the purpose of avoiding the lack of torque transiently risen from the shortage of an actual intake-air quantity from a target intake-air quantity. Therefore, the execution time for the high-response torque correction is finite and the high-response torque correction terminates within the finite time duration. The previously-noted predetermined time duration corresponding to the switching-to-stratified inhibition time duration, is defined as described in steps S10, S22, or S32. Thus, the switching-to-stratified inhibition time duration can be easily set or programmed.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A cylinder direct-injection spark-ignition engine using at least a homogeneous combustion mode where early fuel-injection on intake stroke produces a homogeneous air-fuel mixture and a stratified combustion mode where late fuel-injection on compression stroke produces a stratified air-fuel mixture, comprising:

a control unit configured to be connected to at least an electronic fuel injection system;

said control unit comprising:

a combustion switching section connected to the electronic fuel injection system for switching between the homogeneous combustion mode and the stratified combustion mode depending on an engine operating condition;

a torque-correction demand section for demanding a torque correction of the cylinder direct-injection spark-ignition engine depending on the engine operating condition;

a torque-correction section for making the torque correction by manipulating one of a first unique manipulated variable used in the homogeneous combustion mode and a second unique manipulated variable used in the stratified combustion mode, said first and second unique manipulated variables being different from each other; and a combustion-switching permission decision section for deciding whether execution of a combustion mode change ought to be made, depending on a direction of switching from one of the combustion modes to another combustion mode, when a demand for switching between the combustion modes occurs during the torque correction, wherein said combustion-switching section performs a switching operation from one of the combustion modes to another combustion mode, only when the combustion mode change is permitted by said combustion-switching permission decision section.

2. The cylinder direct-injection spark-ignition engine as claimed in claim 1, wherein said combustion-switching permission decision section permits the execution of the combustion mode change immediately when the demand for switching the combustion modes, occurring during the torque correction, corresponds to the demand for switching from homogeneous to stratified combustion mode, and delays the execution of the combustion mode change by a predetermined time duration when the demand for switching the combustion modes, occurring during the torque correction, corresponds to the demand for switching from stratified to homogeneous combustion mode.

3. The cylinder direct-injection spark-ignition engine as claimed in claim 2, wherein the predetermined time duration is set at a period of time measured from a point of time when the demand for switching from homogeneous to stratified combustion mode occurs to a point of time when a required torque correction value (|100-PIPER|(%)) becomes below a predetermined criterion ($\epsilon 1$ (%)).

4. The cylinder direct-injection spark-ignition engine as claimed in claim 2, wherein the predetermined time duration is set at a period of time from a point of time when the demand for switching from homogeneous to stratified combustion mode occurs to a point of time when the first unique manipulated variable ($|\Delta Adv0|$) used in the homogeneous combustion mode becomes below a predetermined value ($\epsilon 2$).

5. The cylinder direct-injection spark-ignition engine as claimed in claim 2, wherein the predetermined time duration is set at a predetermined elapsed time duration ($\epsilon 3$) measured from a point of time when the demand for switching from homogeneous to stratified combustion mode occurs.

6. The cylinder direct-injection spark-ignition engine as claimed in claim 1, wherein the first and second unique manipulated variables used for the torque correction have a higher response than an intake air, and the torque correction based on one of the first and second unique manipulated variables is transient and is made for a finite time duration and then terminates.

7. The cylinder direct-injection spark-ignition engine as claimed in claim 6, wherein said torque-correction section is connected to an electronic spark-timing control system and to an electronically-controlled throttle valve for making the torque correction, and wherein the first unique manipulated variable used in the homogeneous combustion mode is a spark-timing ($\Delta Adv0$), whereas the second unique manipulated variable used in the stratified combustion mode is an equivalent-ratio correction factor ($\Delta\phi 0$).

8. An electronic engine control method for a cylinder direct-injection spark-ignition engine having an electronic fuel injection system, an electronic spark-timing control system and an electronically-controlled throttle valve, and using at least a homogeneous combustion mode where early fuel-injection on intake stroke produces a homogeneous air-fuel mixture and a stratified combustion mode where late fuel-injection on compression stroke produces a stratified air-fuel mixture, comprising the steps of:

switching between the homogeneous combustion mode and the stratified combustion mode depending on an engine operating condition;

demanding a torque correction of the cylinder direct-injection spark-ignition engine depending on the engine operating condition;

making the torque correction by manipulating one of a first unique manipulated variable used in the homogeneous combustion mode and a second unique manipulated variable used in the stratified combustion mode, said first and second unique manipulated variables being different from each other;

deciding whether execution of a combustion mode change ought to be made, depending on a direction of switching from one of the combustion modes to another combustion mode, when a demand for switching between the combustion modes occurs during the torque correction;

permitting a switching operation from the stratified combustion mode to the homogeneous combustion mode immediately when the demand for switching from stratified to homogeneous combustion mode occurs during the torque correction; and delaying a switching operation from the homogeneous combustion mode to the stratified combustion mode for a predetermined time duration, when the demand for switching from homogeneous to stratified combustion mode occurs during the torque correction.

9. The method as claimed in claim 8, wherein the first and second unique manipulated variables used for the torque correction have a higher response than an intake air, and the torque correction based on one of the first and second unique manipulated variables is transient and is made for a finite time duration and then terminates.

10. The method as claimed in claim 8, wherein the first unique manipulated variable used in the homogeneous combustion mode is a spark-timing ($\Delta Adv0$), whereas the second unique manipulated variable used in the stratified combustion mode is an equivalent-ratio correction factor ($\Delta\phi 0$).

11. The method as claimed in claim 8, wherein the predetermined time duration is set at a period of time measured from a point of time when the demand for switching from homogeneous to stratified combustion mode occurs to a point of time when a required torque correction value (|100-PIPER| (%)) becomes below a predetermined criterion ($\epsilon 1$ (%)).

12. The method as claimed in claim 8, wherein the predetermined time duration is set at a period of time from a point of time when the demand for switching from homogeneous to stratified combustion mode occurs to a point of time when the first unique manipulated variable ($|\Delta Adv0|$) used in the homogeneous combustion mode becomes below a predetermined value ($\epsilon 2$).

13. The method as claimed in claim 8, wherein the predetermined time duration is set at a predetermined elapsed time duration ($\epsilon 3$) measured from a point of time when the demand for switching from homogeneous to stratified combustion mode occurs.

* * * * *